US011760550B2

(12) United States Patent
Butler et al.

(10) Patent No.: US 11,760,550 B2
(45) Date of Patent: Sep. 19, 2023

(54) THREADED FLANGE FOR A FLEXIBLE TANK

(71) Applicant: Avon Engineered Fabrications, LLC, Picayune, MS (US)

(72) Inventors: Joshua Butler, Ocean Springs, MS (US); Trinity Lauga, Mandeville, LA (US); Robert Homes, Long Beach, MS (US)

(73) Assignee: Avon Engineered Fabrications, LLC, Picayune, MS (US)

( * ) Notice: Subject to any disclaimer, the term of this patent is extended or adjusted under 35 U.S.C. 154(b) by 219 days.

(21) Appl. No.: 17/145,138

(22) Filed: Jan. 8, 2021

(65) Prior Publication Data

US 2022/0221092 A1 Jul. 14, 2022

(51) Int. Cl.
*F16L 23/032* (2006.01)
*B65D 75/58* (2006.01)
*B65D 1/00* (2006.01)

(52) U.S. Cl.
CPC ..... *B65D 75/5877* (2013.01); *B65D 1/00* (2013.01)

(58) Field of Classification Search
CPC ..... B65D 75/5877; B65D 75/5872; B65D 75/5861; B65D 25/20; B65D 25/48; B65D 77/068; B65D 83/28; B65D 83/306; B65D 33/02
USPC ..... 220/601, 661, 86.1; 222/567
See application file for complete search history.

(56) References Cited

U.S. PATENT DOCUMENTS

| | | | | |
|---|---|---|---|---|
| 2,724,418 | A | 11/1955 | Krupp | |
| 3,074,837 | A | 1/1963 | Valer | |
| 5,303,837 | A * | 4/1994 | Adams | B65D 47/121 220/276 |
| 8,777,050 | B1 | 7/2014 | Joshi | |
| 9,138,938 | B1 | 9/2015 | Joshi | |
| 2003/0168481 | A1 * | 9/2003 | Costin | B65D 77/065 222/567 |
| 2020/0207531 | A1 * | 7/2020 | Barron | B65D 75/5883 |
| 2022/0024637 | A1 * | 1/2022 | Bast | B65D 85/72 |

* cited by examiner

*Primary Examiner* — Robert Poon
(74) *Attorney, Agent, or Firm* — The Watson IP Group, PLC; Jovan N. Jovanovic

(57) ABSTRACT

A threaded flange for a flexible tank that has a base, an upstanding passage, an upstanding support assembly and a grasping member. The base has an upper surface, and a lower surface opposite the upper surface, and an outer perimeter and an inner opening. The upstanding passage extends upwardly away from the upper surface of the base and has a lower end and an upper end, an inner surface and an outer surface, with the inner surface being threaded. The upstanding support assembly comprises a plurality of ribs extending outwardly from the outer surface of the upstanding passage and upwardly from the upper surface of the base. The grasping member is accessible from the lower surface of the base, wherein the grasping member is accessible by and structurally configured for coupling with a tool.

15 Claims, 11 Drawing Sheets

THREADED FLANGE FOR A FLEXIBLE TANK

CROSS-REFERENCE TO RELATED APPLICATION

NA

BACKGROUND OF THE DISCLOSURE

1. Field of the Disclosure

The disclosure relates in general to a threaded flange, and more particularly, to a threaded flange suitable for use in association with a flexible tank, to, in turn, provide an inlet, outlet, and/or venting for the cavity formed by the flexible tank.

2. Background Art

Flexible tanks for the storage of different materials are known. Some such flexible tanks are flexible in nature and can be utilized to store liquids, including but not limited to water, fuel, chemicals, gels, suspensions, among others, typically flowable material termed liquids (wherein the term fluid comprises a liquid in the definition of one of the four fundamental states of matter). Such flexible tanks are often made of a woven fabric made from fibers (typically a polymer such as nylon) and coated with polymers (such as polyurethane of polyethylene, among others). These materials are exemplary and not to be deemed limiting. Such woven fabrics have a number of different types, weights, configurations, and materials. The woven fabrics are typically provided in rolls of fabric that is cut and seamed through techniques such as heat welding, RF welding, among other techniques known to those of skill in the art (for purposes of the present application, the term welding will be understood to mean any number of joining techniques, including but not limited to those identified in this paragraph or elsewhere in the disclosure).

In contrast to steel flexible tanks, flexible tanks are relatively easy to transport, unfold, and deploy. These features make them popular and well suited for applications in remote locations and temporary installations, such as military installations and for emergency services (while not being limited to either).

Known flexible tanks typically have open and closed tops, and are sometimes round in construction. One such known flexible tank is sold under the name Onion Flexible tanks available from SEI Industries LTD of British Columbia, Canada. Such flexible tanks are often utilized by the U.S. Department of Defense (DOD) for the purpose of generating large quantities of drinking water by way of a Reverse Osmosis Water Purification Unit (ROWPU). These drinking water production systems typically utilize 3,000-gallon flexible tanks to hold both pre and post treated water. Of course, the threaded flange is not limited to use with such flexible tanks, but can be utilized with flexible tanks of any types of shapes and sizes from substantially smaller flexible tanks to substantially larger flexible tanks than those disclosed herein.

To access contents within these know flexible tanks, these flexible tanks typically include one or more flanges onto which an apparatus, such as a hose, pipe, vent, or any other apparatus that is couplable to this flange, is coupled to these flexible tanks. This flange is typically a metal, such as brass, that is tightened against the fabric of the flexible tank to prevent leaking of the contents therein. In some instances, a seal is disposed between the metal flange and the flexible tank. In other configurations, polymer based flanges may be utilized, however, such flanges include metal inserts and the like. In either case, such flanges are expensive to make and/or have a propensity to leak or fail.

SUMMARY OF THE DISCLOSURE

The disclosure is directed, in one aspect, to a threaded flange for a flexible tank. The threaded flange comprises a base, an upstanding passage, an upstanding support assembly and a grasping member. The base has an upper surface, and a lower surface opposite the upper surface. The base defines an outer perimeter and an inner opening extending therethrough. The upstanding passage extends upwardly away from the upper surface of the base. The upstanding passage has a lower end proximate the base and an upper end spaced apart therefrom, an inner surface and an outer surface opposite the inner surface. The inner surface is threaded. The upstanding support assembly has a plurality of ribs extending outwardly from the outer surface of the upstanding passage and upwardly from the upper surface of the base. The grasping member is accessible from the lower surface of the base, wherein the grasping member is accessible by and structurally configured for coupling with a tool.

In some configurations, at least a plurality of the plurality of ribs each include a radial inner side at the outer surface and a radial outer side distally spaced therefrom, with a lower end at the upper surface of the base.

In some configurations, the radial outer side is oblique to the upper surface of the base so as to be inclined toward the upper end of the upstanding passage.

In some configurations, the radial outer side is oblique to the upper surface of the base at an angle of between 91° and 120° and more preferably 100°.

In some configurations, the radial outer side has an outward lower fillet proximate the upper surface of the base.

In some configurations, the plurality of the plurality of ribs further includes an upper end which corresponds to the upper end of the base.

In some configurations, the radial outer side terminates at the upper surface of the base spaced apart from the outer perimeter of the base.

In some configurations, the plurality of the plurality of ribs extend axially from the outer surface of the upstanding passage.

In some configurations, the plurality of the plurality of ribs are spaced apart from each other by between 8° and 120° and more preferably between 10° and 90° and more preferably between 12° and 30°.

In some configurations, the plurality of the plurality of ribs are equally spaced about the outer surface of the upstanding passage to define a substantially uniform slot between adjacent ones of the plurality of ribs.

In some configurations, the grasping member comprises a first side body and a second side body. The first side body is positioned on the upper surface of the base and the second side body is positioned on the upper surface of the base. The first side body and the second side body are on opposite sides of each other relative to the upstanding passage. Each of the first side body and the second side body having a bore extending from the lower surface of the base thereinto. The bore of the first side body and the bore of the second side body being interfaceable with a tool.

In some configurations, the first side body and the second side body each interface with at least one rib of the upstanding support assembly.

In some configurations, at least one of the first side body and the second side body spans between a pair of ribs, with a third rib bisecting the respective side body.

In some configurations, both of the first side body and the second side body each span between a pair of ribs, with a third rib bisecting each of the first side body and the second side body.

In some configurations, the flange comprises solely an injection molded polymer. In such a configuration, it is contemplated that there is no insert member, much less an insert member that is made of a metal.

In some configurations, the flange comprises solely an injection molded thermoplastic polyurethane.

In another aspect of the disclosure, the disclosure is directed to a flexible tank having a threaded flange. The flexible tank comprises an inner surface and an outer surface, the flexible tank defining a volume, with an opening in the flexible tank providing ingress into the volume. The threaded flange has a base, an upstanding passage and an upstanding support assembly. The base has an upper surface, and a lower surface opposite the upper surface. The base defines an outer perimeter and an inner opening extending therethrough. The upstanding passageway extends upwardly away from the upper surface of the base, and has a lower end proximate the base and an upper end spaced apart therefrom, an inner surface and an outer surface opposite the inner surface. The inner surface is threaded. The upstanding support assembly comprises a plurality of ribs extending outwardly from the outer surface of the upstanding passage and upwardly from the upper surface of the base. The threaded flange is positioned so that the upper surface of the base is welded to the outer surface of the flexible tank, with the upstanding passage and the upstanding support extending into the volume of the flexible tank. Further, a reinforcing member is provided that has an outer surface and an inner surface, with an outer diameter that is larger than the outer diameter of the base of the threaded flange and an opening that is larger than the inner opening of the base but smaller than the outer perimeter of the base. The inner surface of the reinforcing member is welded to each of the lower surface of the base and the outer surface of the flexible tank surrounding the opening, to, in turn, couple the threaded flange between the reinforcing member and the outer surface of the flexible tank in a fluid tight configuration.

In some configurations, the flexible tank comprises a woven polymer coated with a polyurethane and the threaded flange comprises a thermoplastic polyurethane.

In some configurations, the threaded flange further includes a grasping member accessible from a pair of bores extending through the lower surface of the base. The pair of bores are structurally configured for coupling with a tool. The bores are positioned between the inner opening of the base and the inner opening of the reinforcement member.

In another aspect of the disclosure, the disclosure is directed to A method of using a flexible tank of the type disclosed comprising the steps of: providing a tool; engaging the tool with the grasping member; engaging a fitting with the threads of the inner surface of the upstanding passage; tightening the fitting relative to the threaded flange; and precluding rotation of the threaded flange relative to the flexible tank while executing the step of tightening.

BRIEF DESCRIPTION OF THE DRAWINGS

The disclosure will now be described with reference to the drawings wherein.

DETAILED DESCRIPTION OF THE DISCLOSURE

Figure 1:
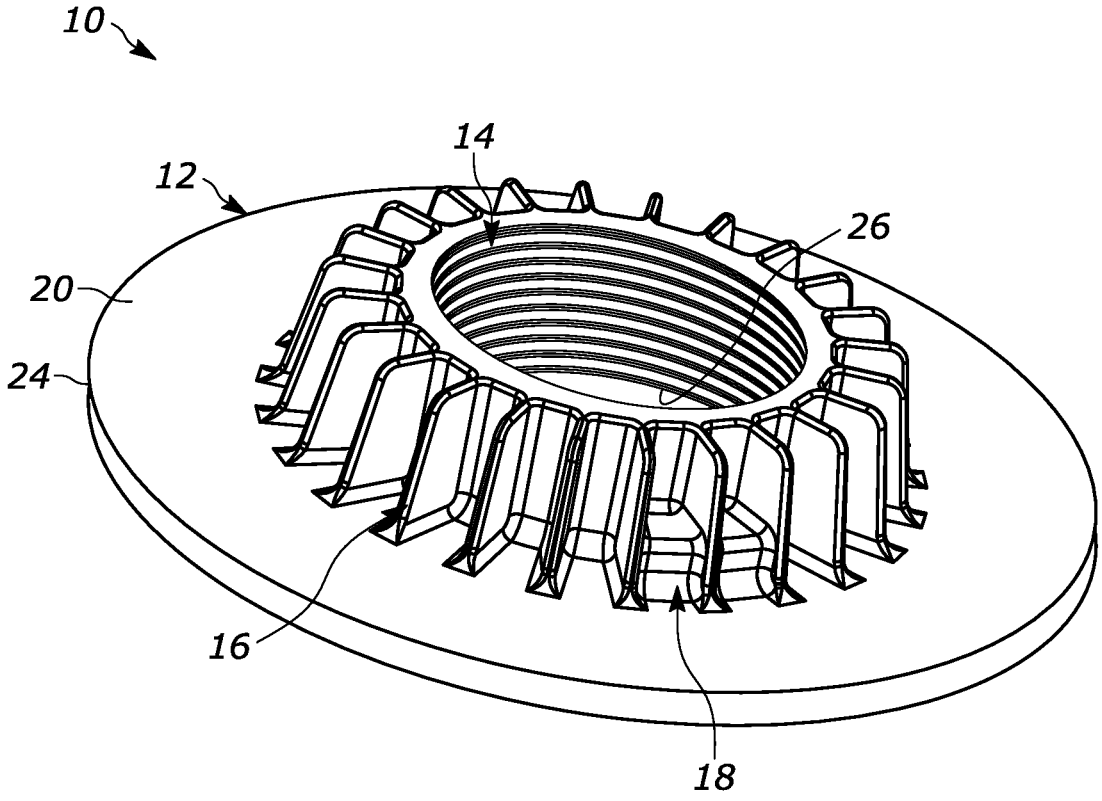
FIG. 1 of the drawings is a perspective view of the threaded flange of the present disclosure.
Figure 2:
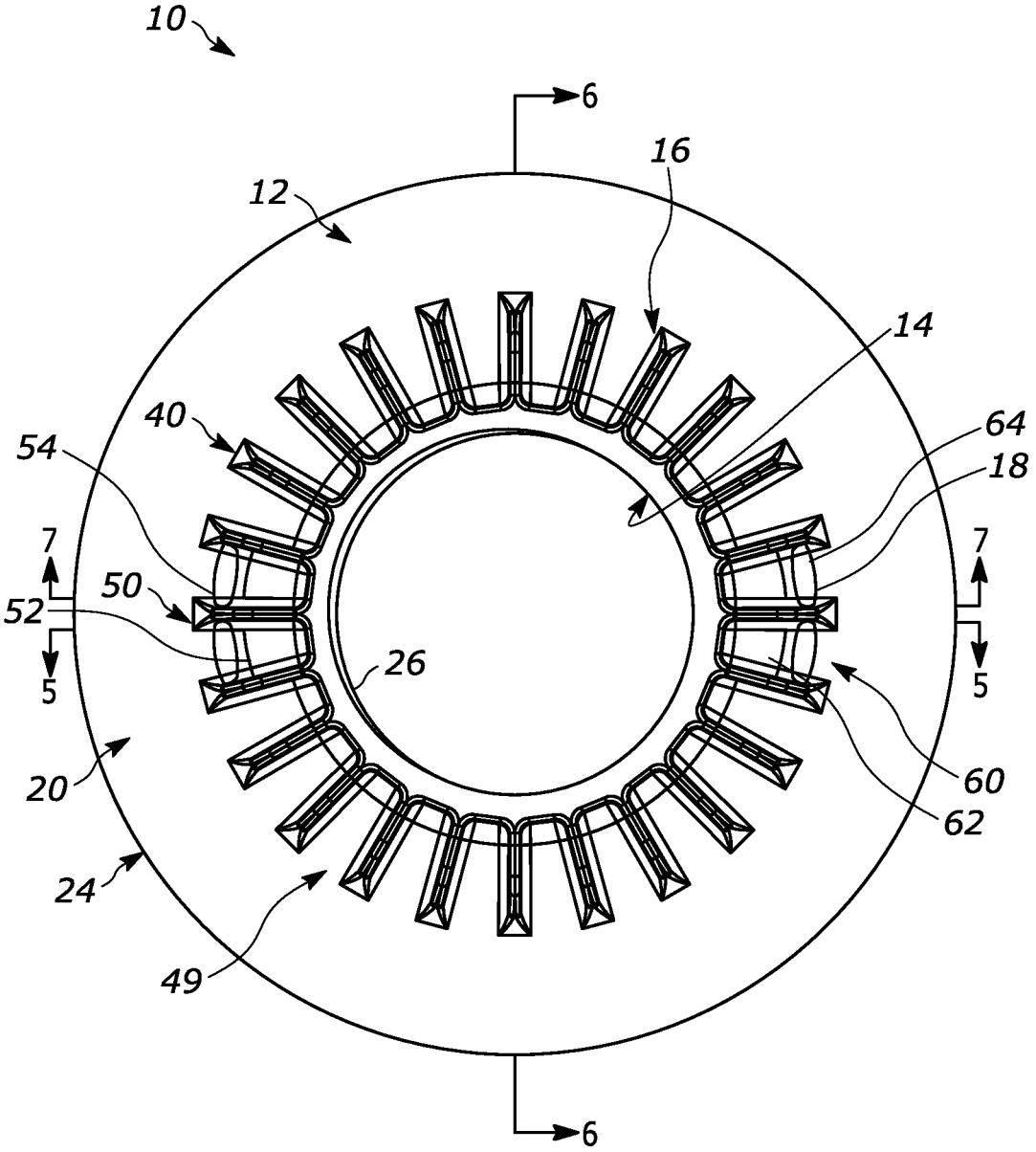
FIG. 2 of the drawings is a top plan view of the threaded flange of the present disclosure.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the threaded flange is shown generally at 10. The threaded flange is configured for use in association with a flexible tank, such as a flexible tank 200. One such flexible tank is disclosed in co-pending application Ser. No. 17/028,589 entitled Flexible tank, having the same applicant as the present application, such flexible tanks have a capacity of between 100 and 300,000 gallons. It will be understood that the flexible tank 200 is not limited to the flexible tank disclosed in the co-pending application, and that such a flexible tank as disclosed is meant to be exemplary. The flange can be utilized in association with a number of different flexible tanks, including but not limited to those identified herein, and in the background of the present disclosure.

With further reference to FIGS. 2 through 7, the threaded flange 10 is shown as comprising base 12, upstanding passage 14, upstanding support assembly 16 and grasping member 18. While a number of configurations are contemplated, the threaded flange is configured such that the opening is between 1.75 inches and 6 inches, and more preferably between 2 inches and 3 inches. Of course, the configuration is not limited to any particular size. The flexible tank is of the type that will be filled with a flowable material comprising a liquid as defined above. In many instances, the liquid comprises water, waste water or fuel, each of example of a liquid is meant to be exemplary and not limiting.

The threaded flange 10 is formed as an integrally molded member that is injection molded. It will be understood that in the configuration shown, the entirety of the threaded flange comprises a polymer, preferably without metal reinforcing members, or metal cores, or the like. Advantageously, in the configuration shown, and preferably, the threaded flange is formed through a single molding operation. Of course, in other configurations, co molding, or conjunctive molding operations (utilizing different polymers, for example) is likewise contemplated.

In addition, it will be understood that the threaded flange is preferably made from a material that is compatible with the material from which the flexible tank is made, such that the flexible tank and the flange can be welded together, wherein welding will be known to mean any number of joining techniques, including, but not limited to, heat welding, RF welding, ultrasonic welding, gluing, seaming and other manners in which to form a fluid tight configuration. In the configuration shown, the flexible tank may be formed from a woven nylon fabric that is coated with a polymer, such as polyurethane. One such fabric is available from Coolie Group under the part number L2838UPW, the properties of which are incorporated herein. In one such configuration, the threaded flange 10 may be formed from a polyurethane. In one such configuration the threaded flange 10 may be formed from an aromatic polyether-based thermoplastic polyurethane. One such product is available from Covestro LLC of Pittsburgh, Pa. under the product Textin® 976D, the properties of which are incorporated herein.

Referring again to the FIGS. 2 through 7, the base 12 of the threaded flange 10 is shown as comprising upper surface 20, lower surface 22, outer perimeter 24 and inner opening 26. In the configuration shown, the upper and lower surfaces are substantially parallel to each other so as to define a substantially planar base member. The outer perimeter, 24 in the configuration shown comprises a circular configuration, while other configurations, such as other polygonal configurations are contemplated. Additionally, non-uniform outer perimeters are likewise contemplated, such as combinations of arcuate and straight configurations. In the configuration shown, the inner opening 26 is generally centered about the base, and, concentric therewith, while variations are contemplated. In the configuration shown, wherein the inner opening has a diameter of 2 inches, the outer perimeter has a diameter of 6 inches, with a thickness of 0.13 inches with the understanding that such a configuration is merely exemplary.

The upstanding passage 14 is shown as comprising lower end 30, upper end 32, inner surface 34 and outer surface 36. In the configuration shown, the upstanding passage extends away from the upper surface 20 of the base 12 in a configuration that is generally perpendicular to the upper surface 20. In other configurations, the upstanding passage may be oblique to the upper surface 20 and/or the lower surface 22 of the base 12. In the configuration shown, the inner surface 34 comprises a uniform configuration having threads 39 disposed between the upper end and the lower end of the upstanding passage. In the configuration shown, the threads extend from the lower end to the upper end continuously, whereas in other configurations, the threads may stop short of either end. In the configuration shown, the upstanding passage has a total height of 1 inch, with the base having a thickness of 0.13 inches.

The upstanding support assembly 16 generally surrounds the upstanding passage 14 and spans (which may also be referred to herein as buttressing) between the upper surface 20 of the base 12 and the outer surface 36 of the upstanding passage. The upstanding support 16 provides support to the upstanding passage and the interface between the upstanding passage and the base. In the configuration shown, a plurality of ribs, such as rib 40 extend radially outwardly at predetermined arcuate intervals from the outer surface 36 of the upstanding passage. In the configuration shown a total of 24 ribs extend radially from the outer surface 36 generally perpendicular to a tangent line at the point of meeting the outer surface, wherein they are spaced about 15° apart from each other, while other spacing is contemplated. That is with fewer ribs, the spacing may be increased and with more ribs, the spacing may be reduced. It is contemplated that the spacing may be between approximately 8° and 120° and more preferably between 10° and 90° and more preferably between 10° and 45° and more preferably between 12° and 25°. The radial outer side is spaced apart from the outer perimeter of the base. In the configuration shown, the radial outer side at the base defines a 4 inch perimeter concentric with the 2 inch opening, and the 6 inch outer perimeter of the base. A slot, such as slot 49 is defined between adjacent ones of the ribs.

It will be understood that a greater or fewer number of ribs can be utilized, as well as ribs or the like that extend oblique to a tangent taken about the pointe of intersection with the outer surface 36 of the upstanding passage. It will also be understood that while a single rib is shown as emanating radially from the outer surface, a plurality of ribs may emanate from a single location on the outer surface. Furthermore, in the configuration shown, the ribs are generally substantially planar, and generally perpendicular to both a tangent on the outer surface from the spot of emanation, and also perpendicular to the upper surface of the base. Furthermore, the ribs of the configuration shown are generally substantially identical dimensionally, it will be understood that variations are contemplated, and it will be understood that the ribs may be other than substantially identical to one another.

Figure 8:
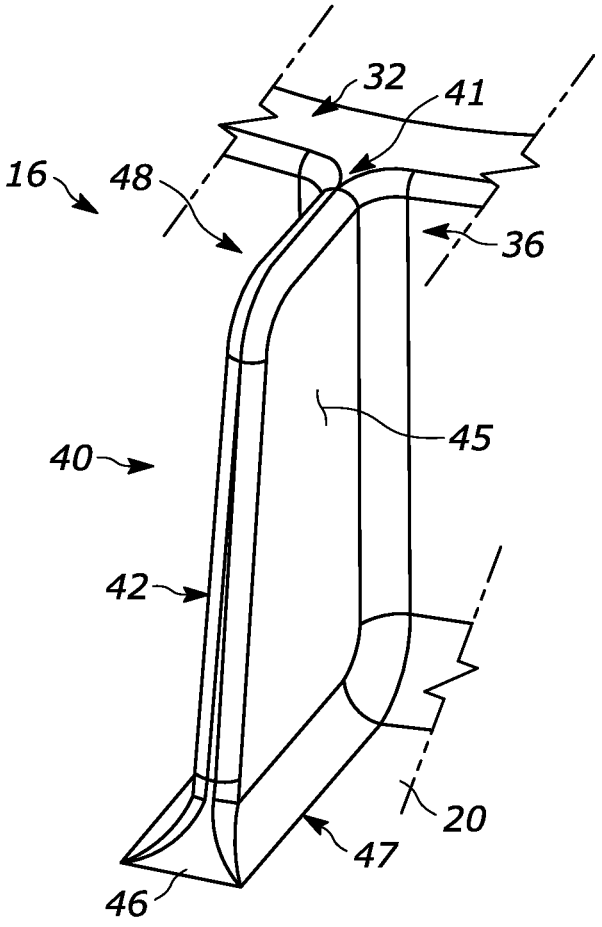
FIG. 8 of the drawings is a partial perspective view of the threaded flange of the present disclosure, showing, in particular a rib if the upstanding support assembly.
Figure 9:
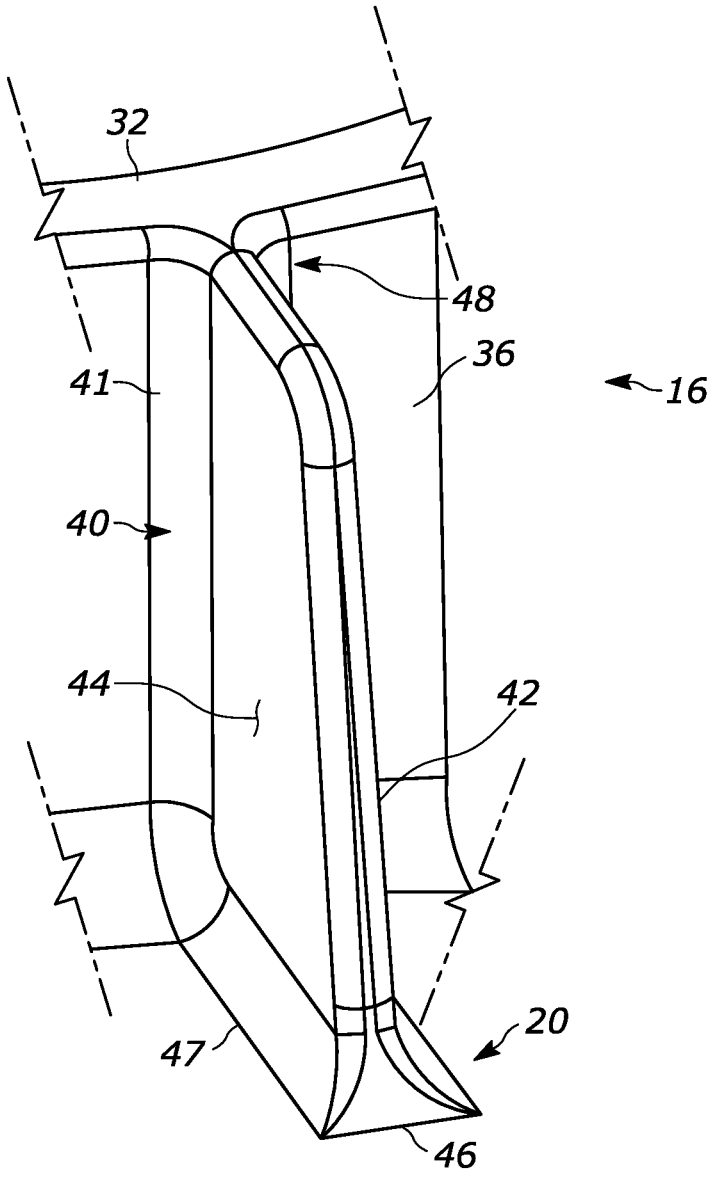
FIG. 9 of the drawings is a partial perspective view of the threaded flange of the present disclosure, showing, in particular a rib of the upstanding support assembly.

The ribs are shown in greater detail in FIGS. 8 and 9. It will be understood that a rib 40 will be described in detail with the understanding that the remaining ribs of the configuration shown are substantially identical thereto. In other configurations, there may be variations in the ribs and between various ribs. Rib 40 includes radial inner side 41, radial outer side 42 extending away from the outer surface 36 of the upstanding passage. The rib is defined by a first side 44 and a second side 45 opposite the first side 44, with the sides being one of parallel to each other or being angled so as to become thinner proximate the upper end 48 and thicker at the lower end 47. Of course, other variations are contemplated. A lower radially outward fillet 46 may be present at the intersection between the radial outer side 42 and the upper surface 20 of the base. Additionally, both sides may be filleted where they meet both the outer surface of the upstanding passage and also the upper surface of the base 12.

In the configuration shown, the radial outer surface may be oblique to the upper surface of the base so that the radial outer side is closer to the outer surface of the upstanding passage proximate the upper end of the upstanding passage. In the configuration shown, the radial outer side is angled at about 100° relative to the upper surface of the base, while it is contemplated that the angle may be between 91° and 120° in other configurations. In some configurations, the two may be perpendicular to each other or substantially perpendicular to each other. Additionally, in the configuration shown, the upper end 48 of the ribs corresponds to the upper end 32 of the upstanding passage, while in other configurations, the ribs may extend beyond the upper end of the upstanding passage, or, in still other configurations, the upper end of the upstanding passage extends beyond the upper end of the ribs.

In the configuration shown, the ribs are substantially continuous and substantially free of voids or the like. In some configurations, the ribs may include openings or the like which extend between the first side 44 and the second side 45. In other configurations, multiple openings may be strategically positioned therebetween. In addition, the surfaces are shown as being substantially planar, but variations are contemplated.

Figure 3:
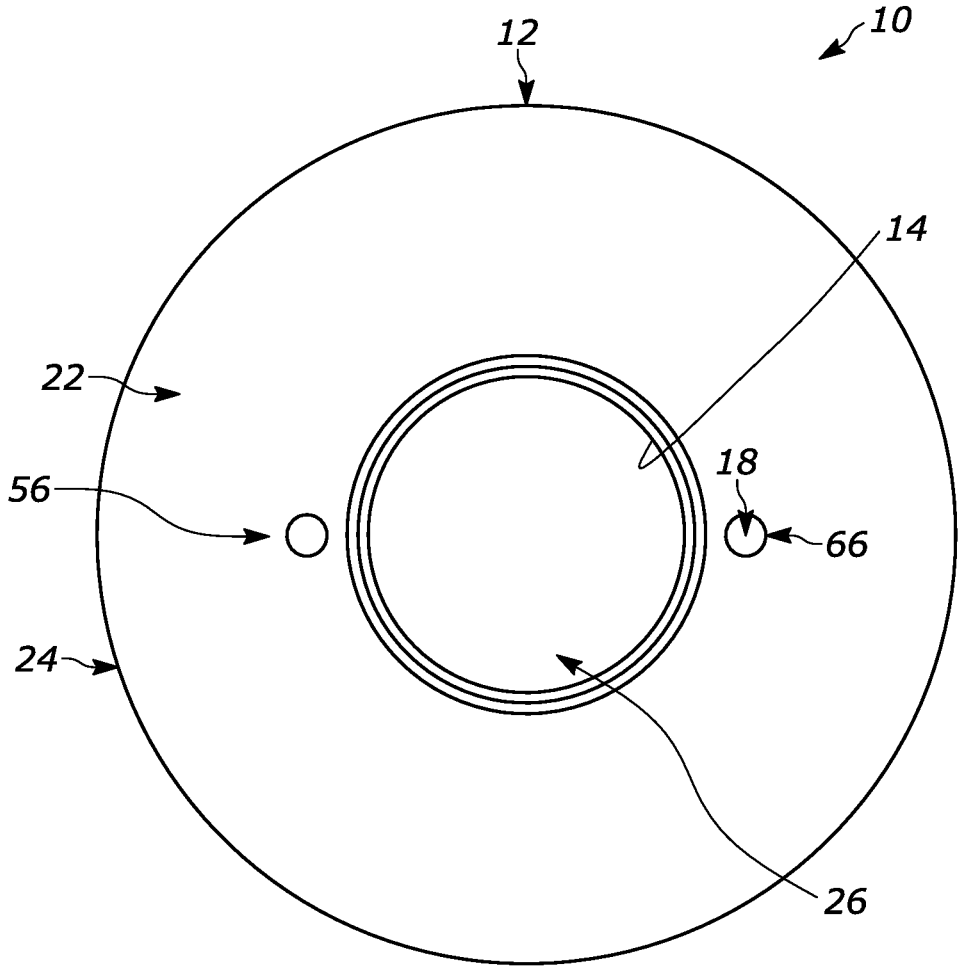
FIG. 3 of the drawings is a bottom plan view of the threaded flange of the present disclosure.
Figure 4:
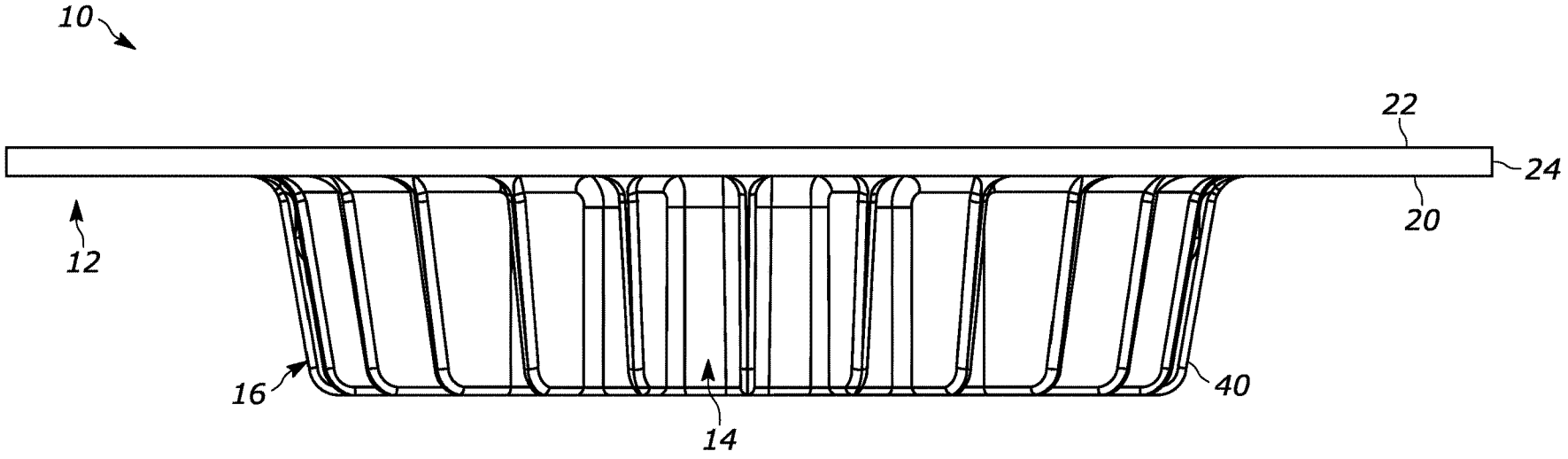
FIG. 4 of the drawings is a side elevational view of the threaded flange of the present disclosure.
Figure 5:
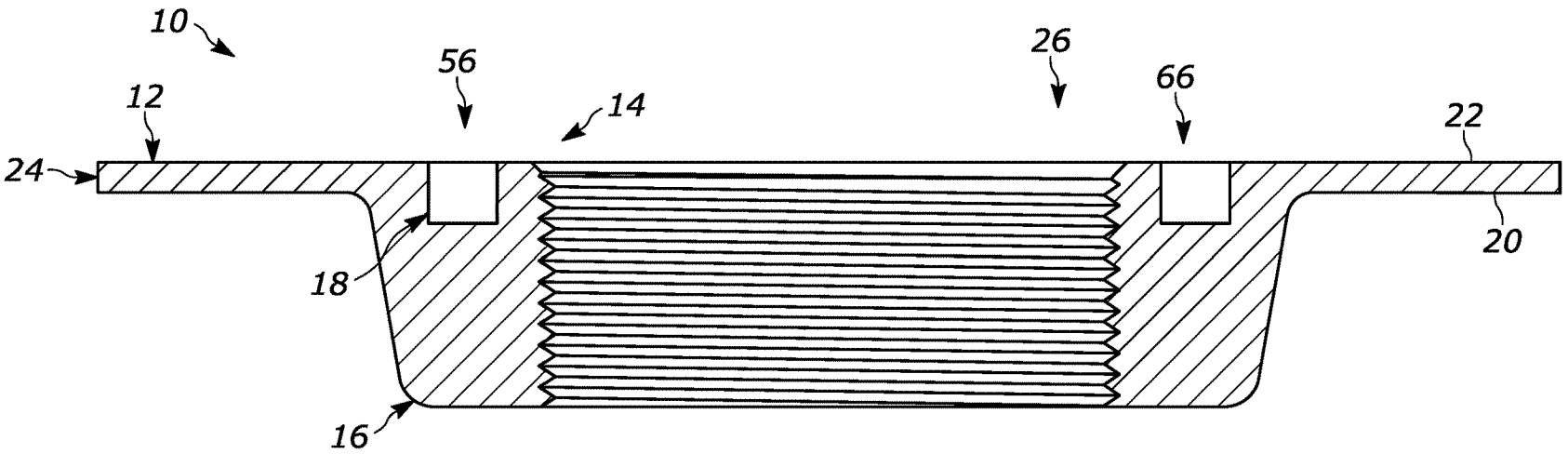
FIG. 5 of the drawings is a cross-sectional view of the threaded flange of the present disclosure taken about lines 5-5 of FIG. 2.
Figure 6:
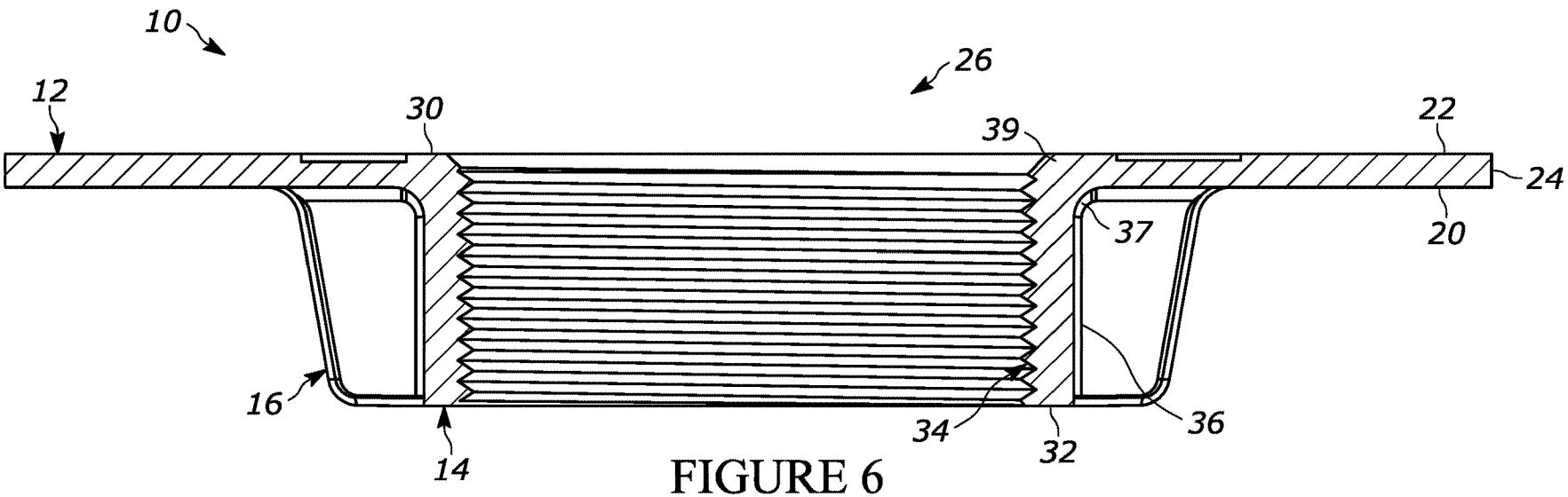
FIG. 6 of the drawings is a cross-sectional view of the threaded flange of the present disclosure taken about lines 6-6 of FIG. 2.
Figure 7:
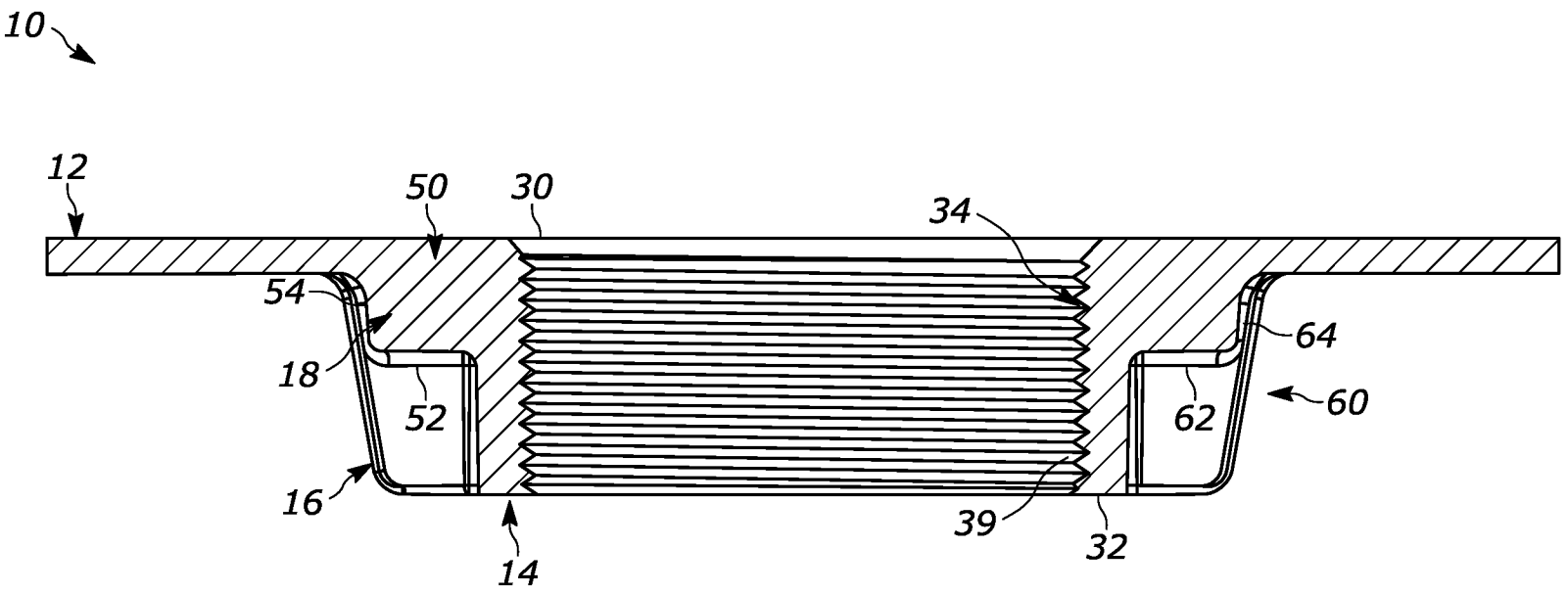
FIG. 7 of the drawings is a cross-sectional view of the threaded flange of the present disclosure taken about lines 7-7 of FIG. 2.

The grasping member 18 is shown in FIGS. 3, 5 and 7. The grasping member is configured to allow for a wrench or the like to grasp and retain the flange while a fitting is threaded thereonto. In other words, the flange is substantially precluded from rotating, and/or applying a torque to the joint with the flexible tank to which it is attached. In the configuration shown, the grasping member comprises a first side body 50 and a second side body 60. The two bodies are positioned on opposite sides of each other (i.e., 180° apart from each other). The two bodies are disposed on the upper surface of the base 12 and span between two ribs with a third rib bisecting each of the two bodies.

The first side body and the second side body are substantially mirror images of each other. The first side body 50 includes upper end 52 and outer end 54. The upper end, in the configuration shown, is substantially parallel to the upper surface of the base, with the outer end being arcuate and concentric with the inner opening 26 and/or the outer perimeter. In the configuration shown, the outer end 54 is axially inward of the radial outer side 42 of the ribs spanning and bisecting the first side body. A first side bore extends 56 through the lower surface 22 of the base 12 and into the first side body. In the configuration shown, the bore has a diameter of 0.281 inches, while other configurations are contemplated. The bore is centered away from the center of the outer surface by approximately 3 inches in the configuration shown, and the bore is entirely encased within the first side body.

The second side body is substantially identical to the first side body (but on an opposite side of the upstanding passage, i.e., 180° apart) and includes upper end 62 and outer end 64. The upper end is likewise substantially parallel to the upper surface of the base, with the outer end being arcuate and concentric with the inner opening 26 and/or the outer perimeter. A second side bore 66 extends through the lower surface 22 of the base 12 and into the second side body. The bore has the same configuration and placement as the first side bore. Of course, variations are contemplated in the size and position of the bores. It is further contemplated that pins or other projections may be utilized in the place of bores as grasping members, which allow for the grasping and fixing of the flange relative to the fitting being attached thereto, and relative to the flexible tank to limit, and/or preclude damage to the flexible tank or to the interface between the flexible tank and the flange.

Figure 10:
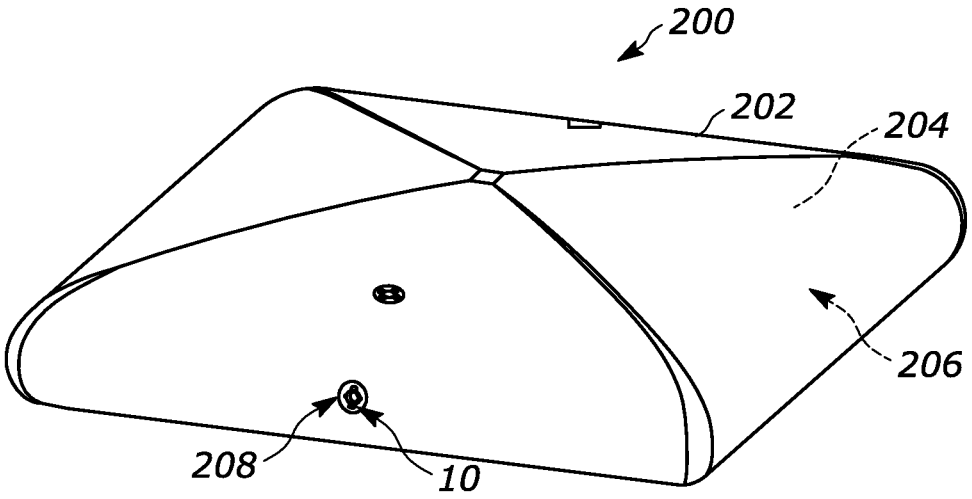
FIG. 10 of the drawings is a perspective view of a flexible tank of the present disclosure with which the threaded flange may be utilized.
Figure 11:
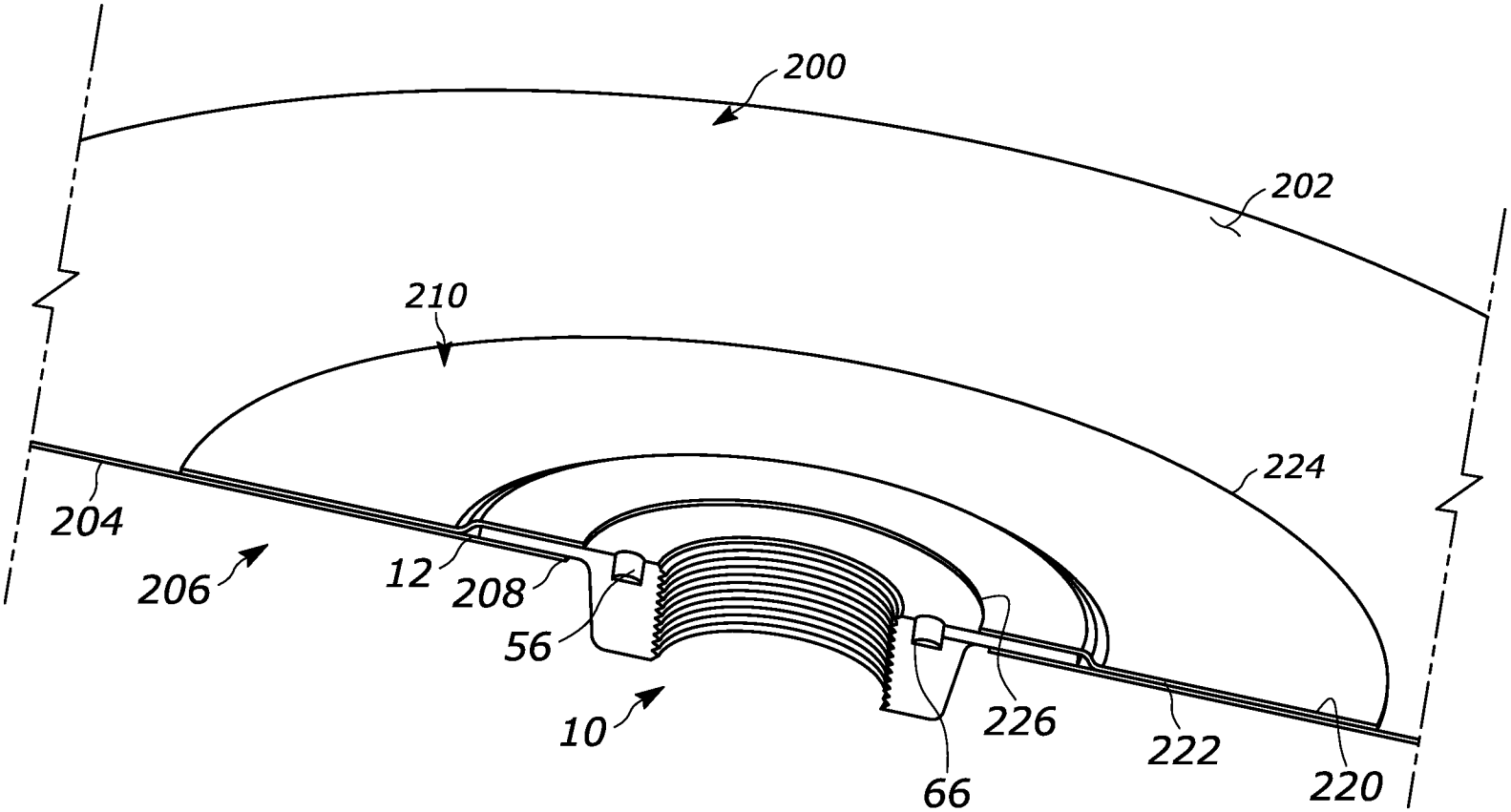
FIG. 11 of the drawings is a partial perspective cross-sectional view of a flexible tank of the present disclosure with the threaded flange.
Figure 12:
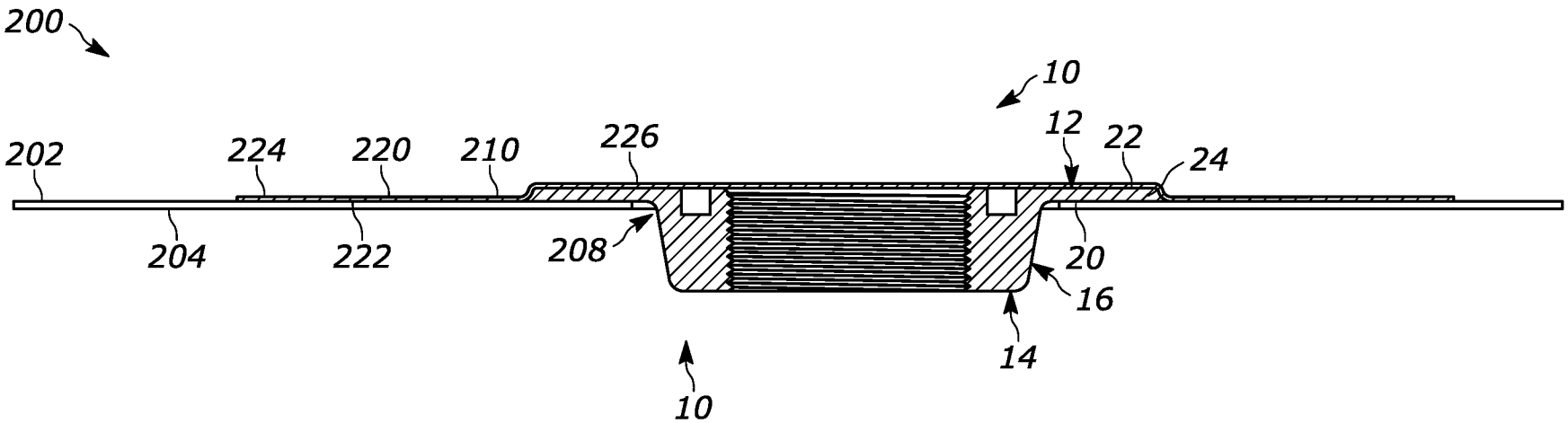
FIG. 12 of the drawings is a partial cross-sectional view of a flexible tank of the present disclosure with the threaded flange.

A configuration of the threaded flange 10 coupled to a flexible tank, such as flexible tank 200 is shown in FIGS. 10 through 12. The flexible tank is formed from one or more panels defining an inner surface 204 and an outer surface 202 and a volume 206 of the flexible tank 200. An opening 208 is defined in the flexible tank 200 to provide ingress into the volume 206. In the configuration shown, the flange is positioned so that the upstanding passage and the upstanding support assembly is directed through the opening so that the upper surface 20 of the base 12 abuttingly engages the outer surface 202 of the flexible tank surrounding the opening 208.

Once positioned, a reinforcement member 210 is introduced so as to provide additional reinforcement to the coupling of the threaded flange to the flexible tank. The reinforcement member comprises a piece of fabric (typically the same fabric from which the flexible tank is formed) having an upper surface 220 and a lower surface 222 that includes an outer perimeter 224 that is larger than the outer perimeter 24 of the base and an inner opening 226 that is smaller than the outer perimeter 24 of the base, but larger than the inner opening 26.

The reinforcement member 210 is positioned to overlie the lower surface 22 of the base 12 so that the outer perimeter of the base is covered by the reinforcement member, and so that the reinforcement member covers a portion of the outer surface of the flexible tank surrounding the opening and the flange.

Once the reinforcement member is positioned, the assembly can be welded together so as to seal the upper surface of the base to the outer surface of the flexible tank around the opening in a fluid tight configuration. Additionally, the reinforcement member is welded to the lower surface of the base and also to the outer surface of the flexible tank. Thus, the base of the flange is sandwiched between the outer surface of the flexible tank and the inner surface of the reinforcement.

In use, typically, a fitting or the like is threadedly engaged with the threads 39 on the inner surface of the upstanding passage. While the threading engagement of the fitting may be done by hand, often, it becomes necessary to utilize a tool to spin the fitting relative to the flange. In such a configuration, it is advantageous to hold the flange and to prevent spinning or rotating of the flange relative to the flexible tank. Such relative movement can damage, compromise, weaken or otherwise negatively impact the sealing joint between the threaded flange and the flexible tank and/or the reinforcement member. To minimize and/or preclude such relative movement, a spanner wrench having opposing pins that are spaced apart a distance corresponding to the distance between the first side bore 56 and the second side bore 66 can be coupled to the flange. By holding the spanner wrench, while rotating the fitting, control over the threaded flange can be maintained while tightening the fitting. Of course, if the grasping member comprises something other than a pair of bores spaced apart, a different tool than a spanner can be utilized.

It will be understood that a plurality of threaded flanges (all of a single size or of multiple different sizes) may be utilized with a single flexible tank. Some of such flanges may be used in association with inlets, outlets and/or vents on a flexible tank. And, it is further contemplated that the different flexible tanks as well as fittings may be utilized without limitation.

Advantageously, the foregoing construction of the threaded flange allows for a threaded flange to be utilized in association with a flexible tank of the type described herein in a fluid tight engagement without the use of gaskets, adhesives, special fittings and metal components that rely on the flexible tank for sealing/gasket properties. Additionally, the threaded flange construction described herein provides a simple, and preferably metal free and/or insert free configuration that is relatively inexpensive to mold and that can be utilized in applications wherein liquids are introduced or removed from a flexible tank of the type described herein.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A threaded flange for a flexible tank, the threaded flange comprising:

a base having an upper surface, and a lower surface opposite the upper surface, the base defining an outer perimeter and an inner opening extending therethrough;

an upstanding passage extending upwardly away from the upper surface of the base, the upstanding passage having a lower end proximate the base and an upper end spaced apart therefrom, an inner surface and an outer surface opposite the inner surface, the inner surface being threaded;

an upstanding support assembly comprising a plurality of ribs extending outwardly from the outer surface of the upstanding passage and upwardly from the upper surface of the base; and a grasping member accessible from the lower surface of the base, wherein the grasping member comprises a first side body and a second side body, the first side body molded into the base and extending upwardly on the upper surface of the base, and molded into the outer surface of the upstanding passage, and the second side body molded into the base and extending upwardly on the upper surface of the base, and molded into the outer surface of the upstanding passage, with the first side body and the second side body being on opposite sides of each other relative to the upstanding passage, and wherein the first side body and the second side body are molded with at least one rib of the upstanding support assembly each of the first side body and the second side body each having a bore extending from the lower surface of the base thereinto and being perpendicular to the lower surface of the base, with the bore of the first side body and the bore of the second side body being interfaceable with a tool.

2. The threaded flange of claim 1 wherein at least a plurality of the plurality of ribs each include a radial inner side at the outer surface and a radial outer side distally spaced therefrom, with a lower end at the upper surface of the base.

3. The threaded flange of claim 2 wherein the radial outer side is oblique to the upper surface of the base so as to be inclined toward the upper end of the upstanding passage.

4. The threaded flange of claim 3 wherein the radial outer side is oblique to the upper surface of the base at an angle of between 91° and 120° and more preferably 100°.

5. The threaded flange of claim 3 wherein the radial outer side has an outward lower fillet proximate the upper surface of the base.

6. The threaded flange of claim 2 wherein the plurality of the plurality of ribs further includes an upper end which corresponds to the upper end of the base.

7. The threaded flange of claim 2 wherein the radial outer side terminates at the upper surface of the base spaced apart from the outer perimeter of the base.

8. The threaded flange of claim 3 wherein the plurality of the plurality of ribs extend axially from the outer surface of the upstanding passage.

9. The threaded flange of claim 8 wherein the plurality of the plurality of ribs are spaced apart from each other by between 8° and 120° and more preferably between 10° and 90° and more preferably between 12° and 30°.

10. The threaded flange of claim 8 wherein the plurality of the plurality of ribs are equally spaced about the outer surface of the upstanding passage to define a substantially uniform slot between adjacent ones of the plurality of ribs.

11. The threaded flange of claim 1 wherein at least one of the first side body and the second side body is integrally molded with three ribs.

12. The threaded flange of claim 11 wherein both of the first side body and the second side body are each integrally molded with three ribs.

13. The threaded flange of claim 1 wherein the flange comprises solely an injection molded polymer.

14. The threaded flange of claim 13 wherein the flange comprises solely an injection molded thermoplastic polyurethane.

15. A combination flexible tank and the threaded flange of claim 1, comprising:

the flexible tank having an inner surface and an outer surface, the flexible tank defining a volume, with an opening in the flexible tank providing ingress into the volume;

wherein the threaded flange is positioned so that the upper surface of the base is welded to the outer surface of the flexible tank, with the upstanding passage and the upstanding support extending into the volume of the flexible tank; and a reinforcing member having an outer surface and an inner surface, with an outer diameter that is larger than the outer diameter of the base of the threaded flange and an opening that is larger than the inner opening of the base but smaller than the outer perimeter of the base;

wherein the inner surface of the reinforcing member is welded to each of the lower surface of the base and the outer surface of the flexible tank surrounding the opening, to, in turn, couple the threaded flange between the reinforcing member and the outer surface of the flexible tank in a fluid tight configuration.

* * * * *